US009901202B2

(12) United States Patent
Shendelman

(10) Patent No.: US 9,901,202 B2
(45) Date of Patent: Feb. 27, 2018

(54) PORTABLE FOOD HANDLING DEVICES

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 14 days.

(21) Appl. No.: 15/150,743

(22) Filed: May 10, 2016

(65) Prior Publication Data

US 2016/0316947 A1 Nov. 3, 2016

Related U.S. Application Data

(63) Continuation-in-part of application No. 14/215,662, filed on Mar. 17, 2014, now Pat. No. 9,345,352.

(60) Provisional application No. 61/790,285, filed on Mar. 15, 2013.

(51) Int. Cl.

| | |
|---|---|
| ***A47B 85/00*** | (2006.01) |
| ***A47G 21/00*** | (2006.01) |
| ***A47G 23/06*** | (2006.01) |
| *A47G 19/02* | (2006.01) |

(52) U.S. Cl.

CPC ..... *A47G 21/001* (2013.01); *A47G 23/0625* (2013.01); *A47G 19/065* (2013.01); *A47G 2023/0666* (2013.01)

(58) Field of Classification Search

CPC ..... A47G 21/001; A47G 23/0625; A47G 19/065; A47G 2023/0666

USPC ..... 108/25, 26, 50.01, 50.02, 50.11, 50.18; 211/162, 85.4, 51; 206/216, 575; 221/223, 123, 132, 124; 220/23.87, 220/495.03

See application file for complete search history.

(56) References Cited

U.S. PATENT DOCUMENTS

| | | | | | |
|---|---|---|---|---|---|
| 1,221,217 | A | * | 4/1917 | Parran | A47F 1/10 221/119 |
| 1,734,045 | A | * | 11/1929 | Parran | G07F 11/00 194/300 |
| 2,013,901 | A | * | 9/1935 | Shankland | A47F 1/10 221/132 |
| 2,049,114 | A | * | 7/1936 | Gallamore | A47B 3/083 108/25 |
| 3,193,139 | A | * | 7/1965 | Iannone | G07F 11/045 194/300 |
| 3,344,951 | A | * | 10/1967 | Gervais | B65D 83/0418 221/198 |
| 4,295,579 | A | * | 10/1981 | Haas | B65D 83/0418 206/536 |
| 4,589,575 | A | * | 5/1986 | Rigberg | B65D 83/0418 206/535 |
| 5,012,936 | A | * | 5/1991 | Crum | A47F 1/126 206/556 |
| 5,071,033 | A | * | 12/1991 | Siwek | B65D 83/0409 221/229 |
| 5,178,298 | A | * | 1/1993 | Allina | B65D 83/0418 206/457 |

(Continued)

*Primary Examiner* — Jose V Chen

(74) *Attorney, Agent, or Firm* — Kirschstein, Israel, Schiffmiller & Pieroni, P.C.

(57) ABSTRACT

A food handling device for use in eating a foodstuff, includes a holder and a movable member supported by the holder for longitudinal or rotational movement relative to the holder by a user. The movable member engages the foodstuff. Multiple food handling devices may be mounted on a serving platter of a food service assembly.

15 Claims, 16 Drawing Sheets

(56) References Cited

U.S. PATENT DOCUMENTS

| | | | | | |
|---|---|---|---|---|---|
| 5,413,229 | A * | 5/1995 | Zuberbuhler | A47F 1/12 | 211/51 |
| 5,460,295 | A * | 10/1995 | Law | A44C 5/003 | 221/185 |
| 5,493,976 | A * | 2/1996 | Hammond | A47B 37/04 | 108/50.12 |
| 6,543,639 | B1 * | 4/2003 | Kovens | B65D 83/0418 | 221/217 |
| 7,703,636 | B2 * | 4/2010 | Sus | A47J 37/1228 | 221/150 A |
| 2013/0277243 | A1 * | 10/2013 | Wu | A47G 7/06 | 206/216 |

* cited by examiner

FIG. 10
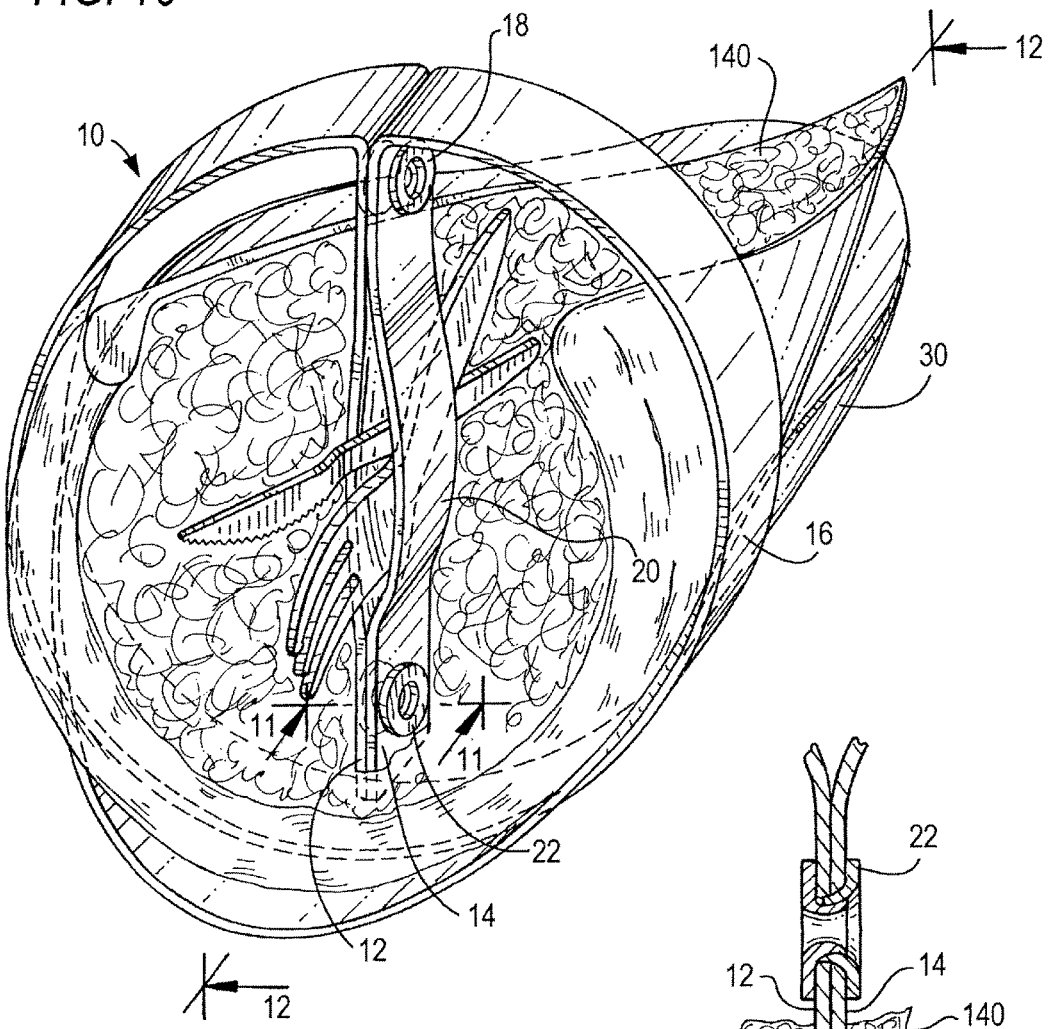
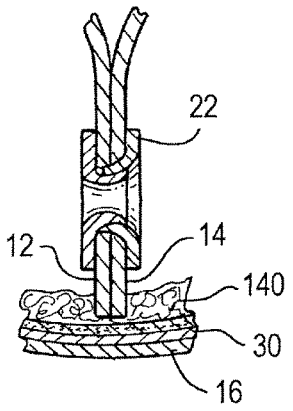
FIG. 11

FIG. 21
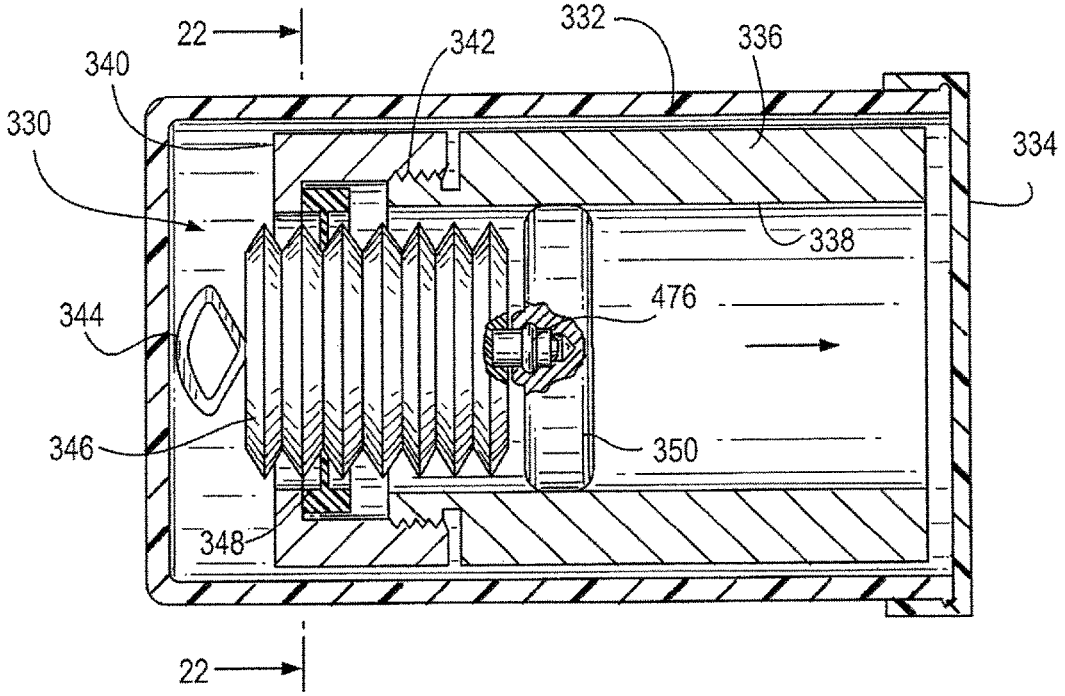
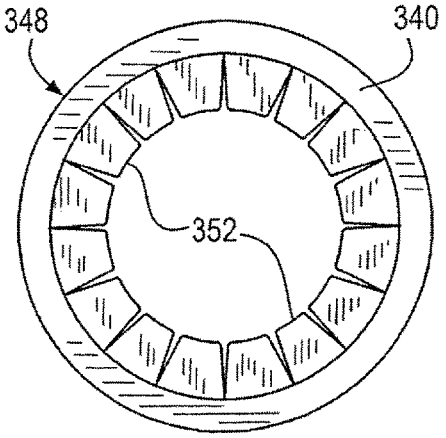
FIG. 22
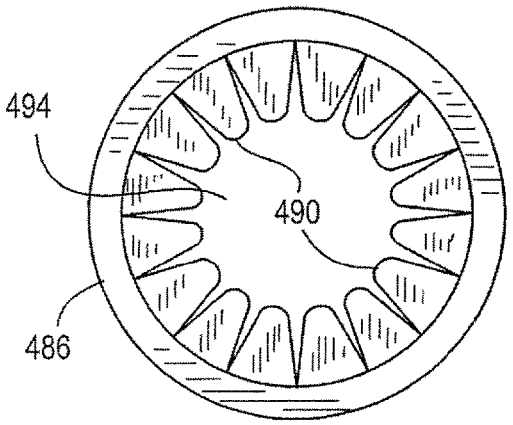
FIG. 25

382
384
380
376
374

374
376
362
364
382
380

372
368
364
362
370
366
370
372
360

FIG. 29
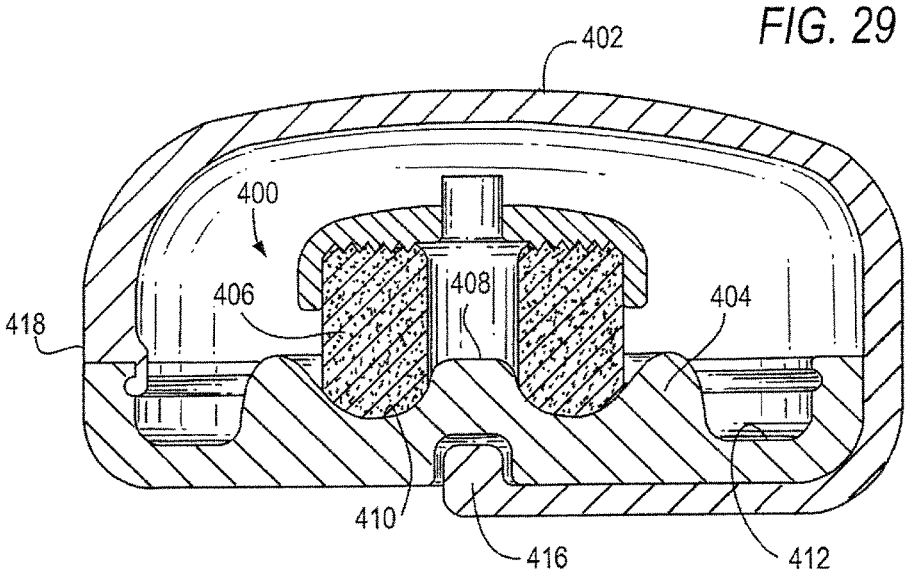
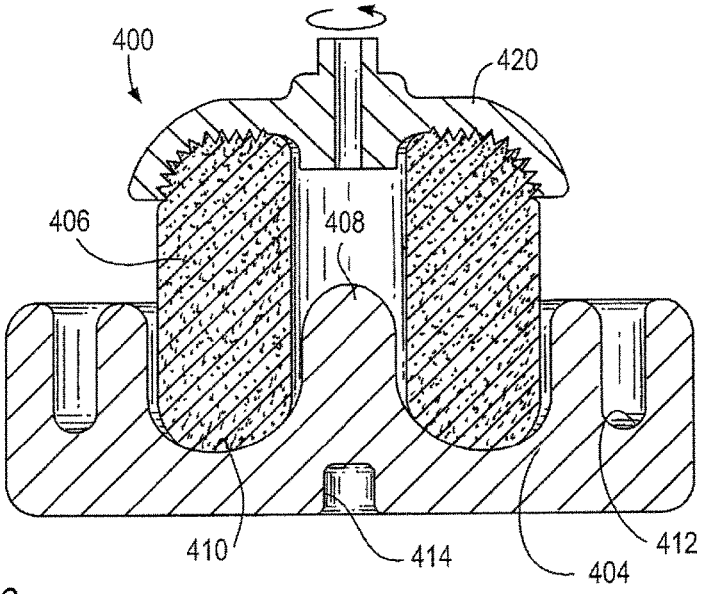
FIG. 30

FIG. 32
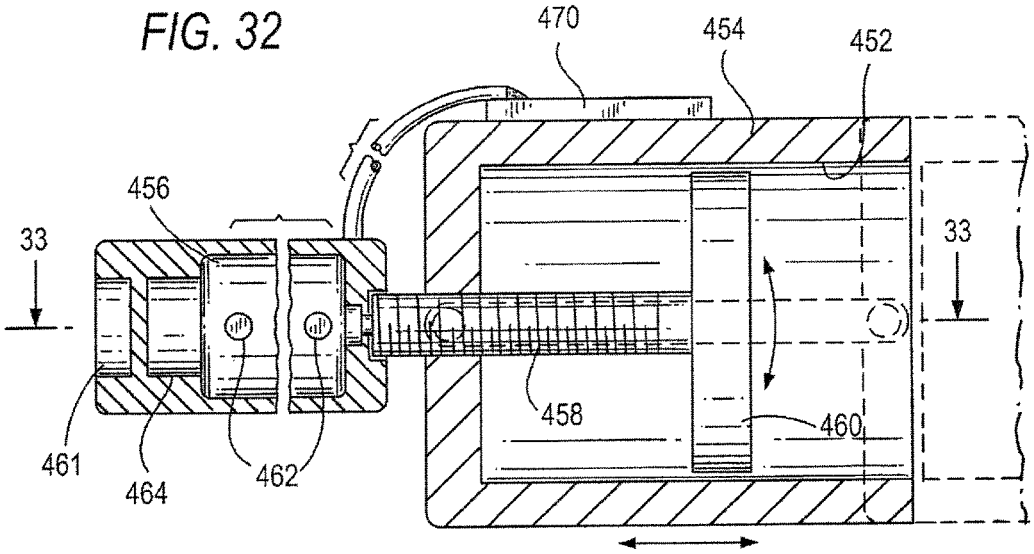
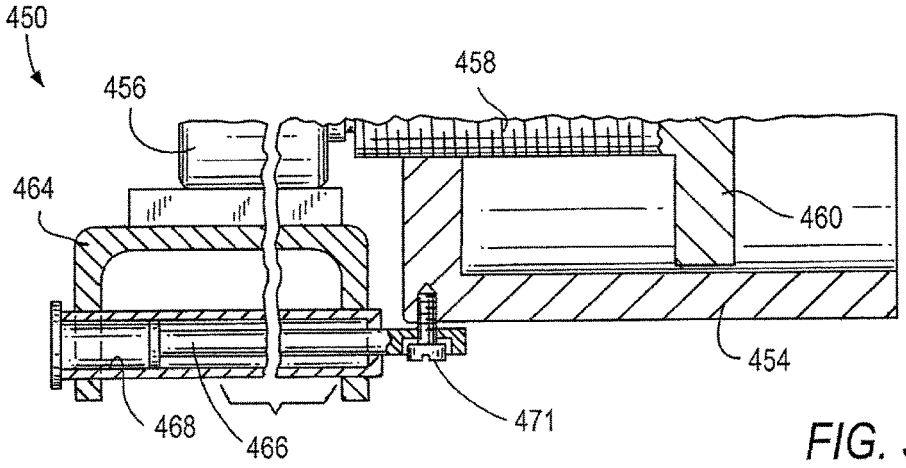
FIG. 33

PORTABLE FOOD HANDLING DEVICES

CROSS REFERENCE TO RELATED APPLICATION

This application is a continuation-in-part of U.S. patent application Ser. No. 14/215,662, filed Mar. 17, 2014, now allowed, which claims priority to U.S. Provisional Patent Application No. 61/790,285, filed Mar. 15, 2013, the entire content of which is hereby expressly incorporated herein by reference thereto.

BACKGROUND

The present disclosure generally relates to portable food handling devices for use during eating foodstuffs, especially those often considered as difficult, awkward, or messy to handle, such as slices of pizza, hot dogs, doughnuts, bagels, etc., and, more particularly, for holding and eating such foodstuffs in a sanitary, tidy manner, that is without soiling one's hands, without spilling drippings, pieces, or toppings of the foodstuff, and without requiring the use of any traditional eating utensils, such as knives and forks, and, still more particularly, relates to portable food handling devices that are used to feed solid foodstuffs in a comfortable and sanitary manner directly to a user's mouth without using utensils and can be beneficial in both indoor and outdoor activities, sports arenas, cafeterias, hospitals, rehabilitation facilities, schools, universities, cars, boats, planes, as well as in disaster relief kits, and the like. In addition, the food handling devices are advantageously sized to fit inside lunch boxes.

Pizza is an example of a foodstuff that is often difficult to handle, especially when the foodstuff is hot. The commonest form in which pizza is served is a generally triangular sector slice taken from a circular pie, generally formed when the pie is cut by several diametrical slices, This form is difficult to handle mostly because of the soft and limp nature of the pointed end, which tends to droop and allow any loose toppings, usually lubricated by cheese and sauce, to slide off and often end up on the user's hands, food tray, or lap, or on the floor. Other types of messy foods include, for example, a hot dog, especially when smothered with multiple loose toppings, a hamburger, a gyro, a taco, a burrito, etc. Frequently, toppings, including sauce, can fall off from the foodstuff, even when held with two hands.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the instant disclosure, and explain various principles and advantages of those embodiments.

FIG. 10 is a front perspective view of another embodiment of a food handling device in accordance with this disclosure.

FIG. 11 is a sectional view taken on line 11-11 of FIG. 10.

FIG. 21 is a sectional view of an additional embodiment of a food handling device in accordance with this disclosure.

FIG. 22 is a side view taken on line 22-22 of FIG. 21.

FIG. 25 is an end view of the detail of FIG. 24.

FIG. 29 is a sectional view of yet another embodiment of a food handling device in accordance with this disclosure.

FIG. 30 is an enlarged, sectional view of part of the food handling device of FIG. 29.

FIG. 32 is a part-sectional, part-diagrammatic, view of an additional embodiment of a food handling device in accordance with this disclosure.

FIG. 33 is a sectional view taken on line 32-32 of FIG. 32.

Figure 1:
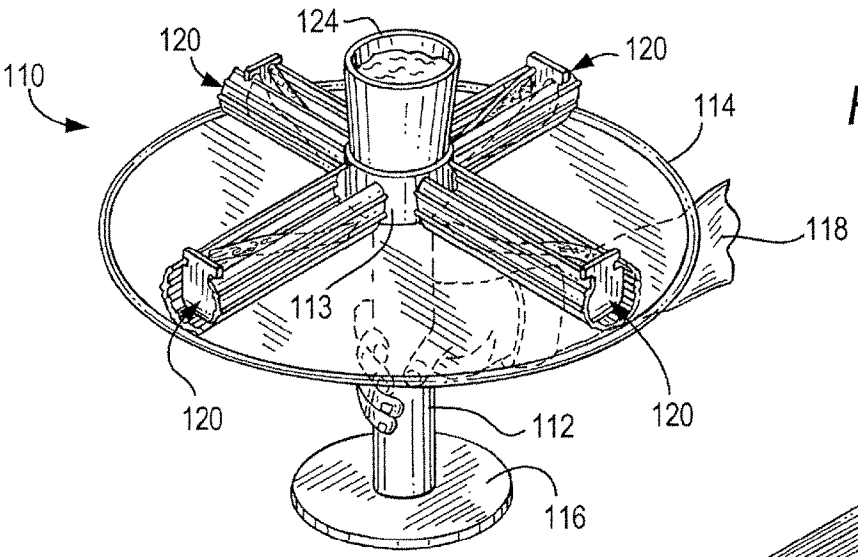
FIG. 1 is a perspective view of a portable food service assembly containing a plurality of food handling devices in accordance with this disclosure.
Figure 2:
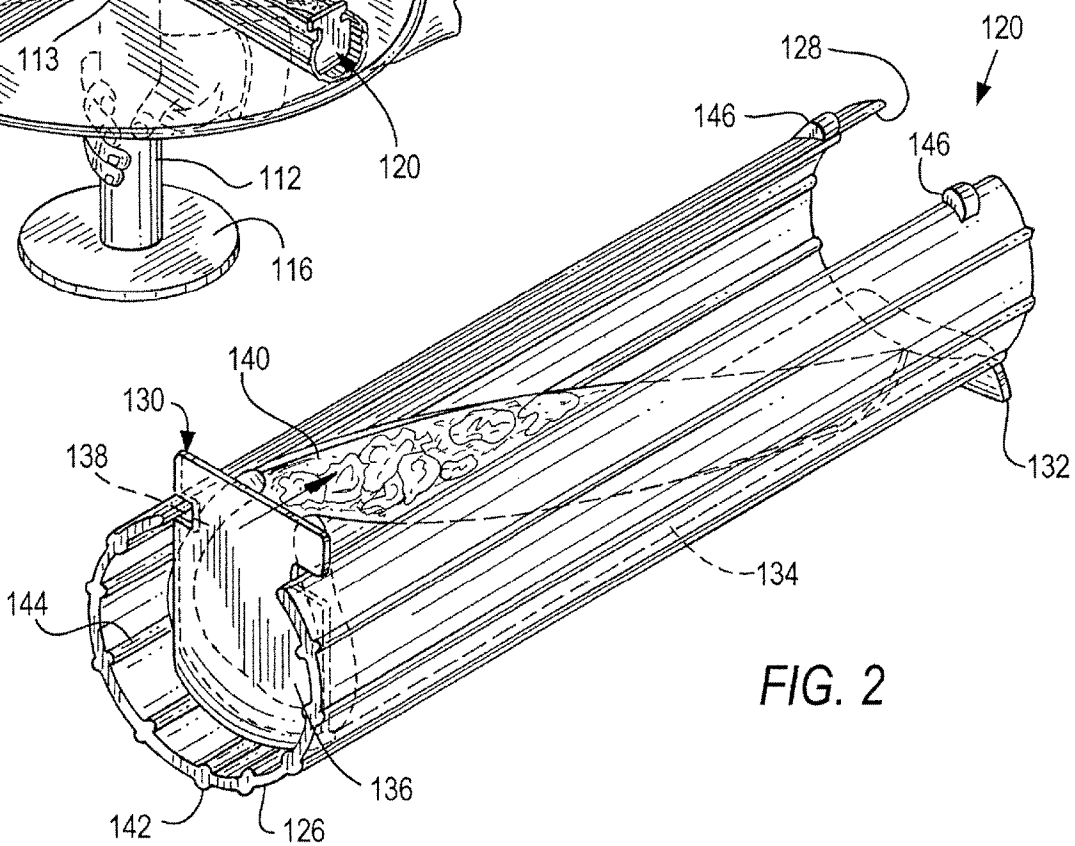
FIG. 2 is an enlarged perspective view of one of the food handling devices of the assembly of FIG. 1.
Figure 3:
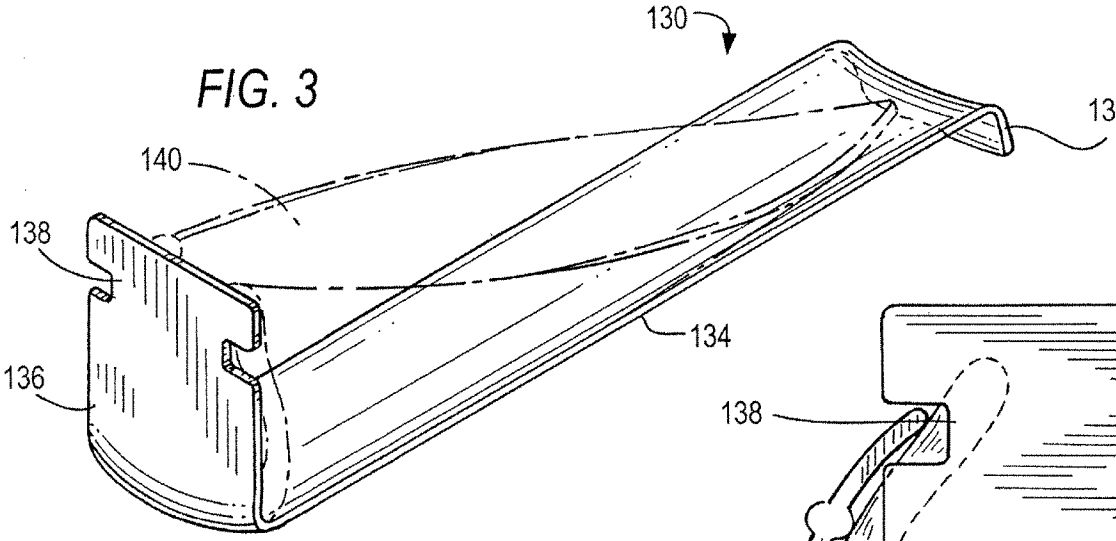
FIG. 3 is an enlarged perspective view of a detail of the device of FIG. 2.
Figure 4:
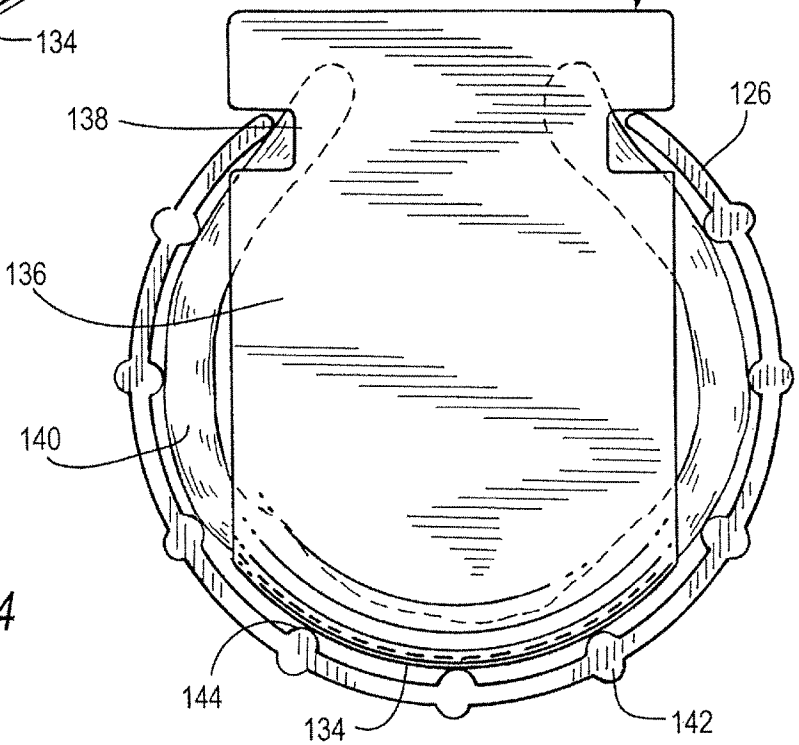
FIG. 4 is an enlarged end view of the device of FIG. 2.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present disclosure.

The device and assembly components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 16:
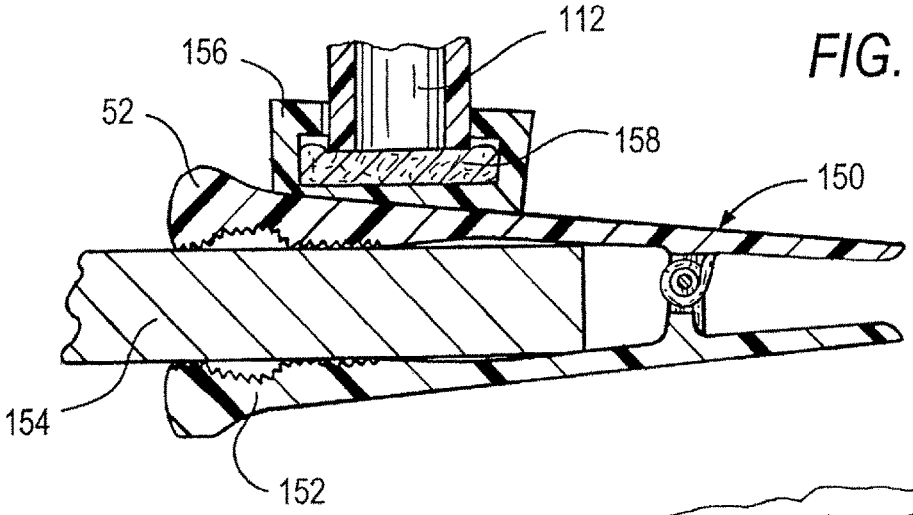
FIG. 16 is a broken-away, enlarged, sectional view of a variant mounting of the food service assembly of FIG. 1.
Figure 17:
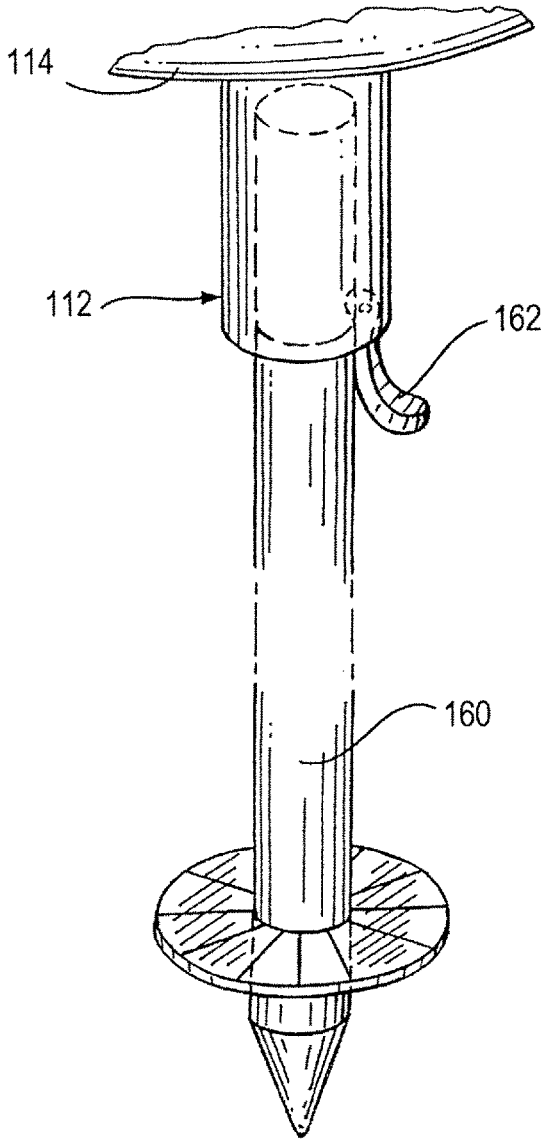
FIG. 17 is a broken-away, side view of another variant mounting of the food service assembly of FIG. 1.
Figure 18:
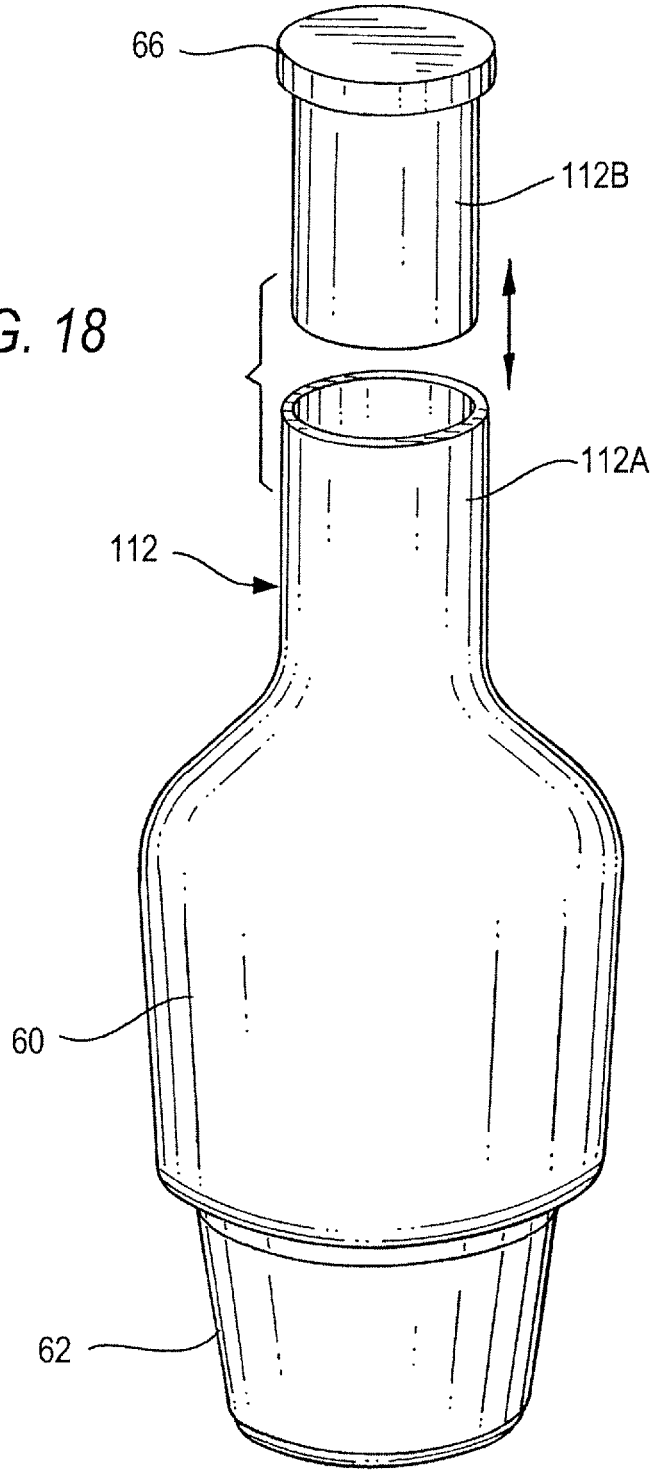
FIG. 18 is a broken-away, side view of another variant mounting of the food service assembly of FIG. 1.

Turning now to FIGS. 1-4, a portable service assembly 110 includes a plate or serving platter 114, a support 112 held by a user 118, and a base 116. The support 112 need not be a cylindrical column as illustrated in FIG. 1, but could have other shapes, e.g., a stepped column, a frustoconical column, or a part-cylindrical and part-frustoconical column. The column could be solid or hollow, and has a diameter sized to be readily gripped in the palm of a user's hand so that the assembly 110 may easily be carried by one hand from place to place. The hollow interior of the column could be used to store any item, such as napkins, straws, electronic devices, utensils, writing implements, condiment packages, etc. The base 116 in FIG. 1 has a planar bottom surface for stable mounting on a support surface, such as the floor or a table. If the support surface is made of a magnetically attractable material, then, in one advantageous embodiment, the bottom surface of the base 116 may be constituted of a magnetic material for magnetic attraction to, and holding by, the magnetically attractable support surface. The base 116 could therefore be of one-piece with the column, or could be a separate detachable part that can be readily attached to the column. For example, the base 116 can be threadedly or magnetically attached to the column, or can be attached by a snap-type action. FIGS. 16-18, as described below, illustrate other mounting arrangements relative to support surfaces.

A drink container or liquid substance-containing cup 124 may be mounted, and held with a friction fit, in a central hollow cylindrical portion 113 of the assembly 110, preferably inside an opening in the platter 114. The container 124 may be removed and replaced at will. The container 124 need not be frustoconical in shape as illustrated, but could have other shapes, e.g., cylindrical. The container 124 may contain water, or cold beverages, such as soda, a milk shake, alcoholic beverages, etc., or hot beverages, such as coffee, tea, hot chocolate, soup, etc., or any semi-liquid substance, such as yogurt, hummus, mustard, ketchup, etc. Use of the container 124 is optional.

A plurality of food handling devices 120 are radially arranged on the platter 114. The food holding devices 120 need not be radially arranged as shown, but could be arranged in different numbers and layouts. A representative food handling device 120 is shown individually in FIG. 2. The food handling device 120 includes a portable, elongated, tubular holder 126 bounding an interior in which a foodstuff, e.g., a slice of pizza, a pastry, a cake, a gyro, a doughnut, a taco, a hot dog, a hamburger, a burrito, a pirogi, a sandwich, etc., is placed. The holder 126 has a longitudinal channel or slot 128. The holder 126 can have various shapes, for example, a cylindrical shape, or a conical shape suitable for compact storage, transport, and handling. A movable member 130, shown individually in the embodiment of FIG. 3, has an elongated support portion or body 134, a handle portion 132 at one end of the body 134, an upright arm portion 136 at an opposite end of the body 134, and a neck portion 138. The movable member 130 is initially positioned inside the holder 126 such that the handle portion 132 is located outside an open axial end of the holder 126, and the neck portion 138 is positioned in the longitudinal slot 128.

Using a slice of pizza 140 (see FIG. 4) as an example of a foodstuff that can advantageously be placed inside the holder 126, the pizza slice 140 is placed on top of the movable member 130 such that its rear crust at its broader end is adjacent the upright arm portion 136. In use, the user 118 takes one of the food handling devices 120 off the platter 14 with one hand, and brings the device 120 near the user's mouth. Then, the user 118 grips and manipulates the handle portion 132 with the user's other hand, and progressively pulls the movable member 130 towards the user 118 with the user's other hand, and incrementally slides the pizza slice 140 out of the holder 126, thereby enabling the user 118 to progressively advance the pointed front leading end of the pizza slice 140 in steps out of the holder 126 towards the user's mouth in order to eat the pizza slice 140 bite-by-bite in a sanitary manner, that is, without dropping any toppings from the pizza slice 140, without soiling one's hands, and without requiring the use of any traditional eating utensils. During the eating, the handle portion 132 is pulled down, thereby bending and folding the support portion 134 out of the way from the user's mouth. Advantageously, the movable member 130 is made of a bendable, flexible material. As noted above, pizza is an unusually difficult food to handle in a non-awkward manner. Prior to use of the food handling device 120, the pizza slice 140 and all its toppings are fully contained within the device 120. During eating, only the leading end of the pizza slice 140 is exposed for eating.

The holder 126 may have sensors 146 to indicate, and to record, the quantity of the foodstuff that has been moved a distance through the holder 126 and has been eaten. This recorded information can be stored, together with the caloric value of the particular foodstuff, and can be sent to remote monitoring facilities that calculate the user's daily calorie consumption data, to thereby monitor the health, and assist in controlling the weight of, the user. The holder 126, together with a foodstuff therein, may be placed in a refrigerator, and subsequently in a thermos or lunch box, for further subsequent consumption in any venue, for example, schools, food stands, workplaces, stadiums, recreational outdoor activities, sporting events, etc. As shown, the outer and inner walls of the holder 126 may be formed with raised outer ribs 142 and/or raised inner ribs 144. The outer ribs 142 enable the user 118 to more securely hold the holder 126. The channels between the inner ribs 144 may collect drippings from the pizza slice 140 or other foodstuff. Both the outer ribs 142 and the inner ribs 144 also serve as thermal insulators to prevent any heat from the pizza slice 140 or other hot foodstuff from being transferred to the user's hand. The holder 126 may be constituted of any material, for example, a resilient material that permits the holder 136 to be squeezed, but when constituted of a corrugated board material, the ribs 142, 144 are advantageously formed of the flutes or corrugations of the board material. The holder 126 may alternatively be provided with smooth outer and inner walls. The holder 126, together with the foodstuff, may also be microwaveable.

Figure 5:
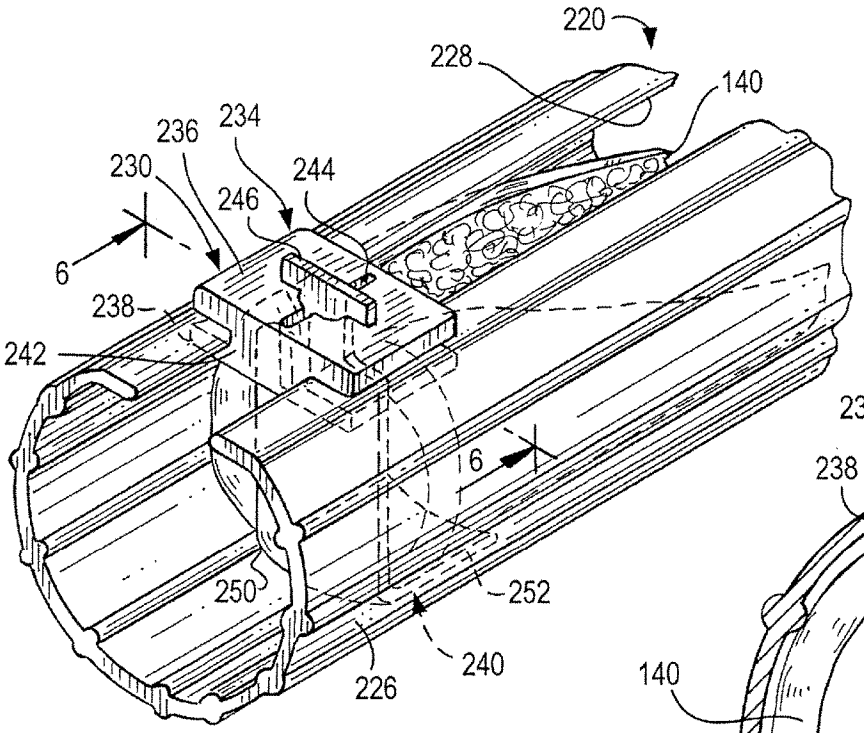
FIG. 5 is a broken-away, enlarged perspective view of another food handling device for the assembly of FIG. 1 in accordance with this disclosure.
Figure 6:
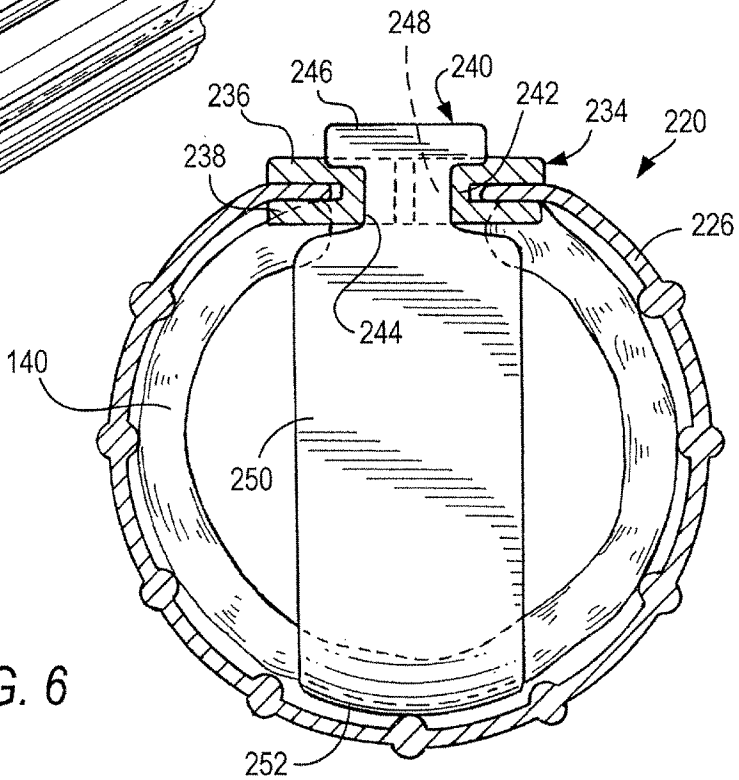
FIG. 6 is a sectional view taken on line 6-6 of FIG. 5.
Figure 7:
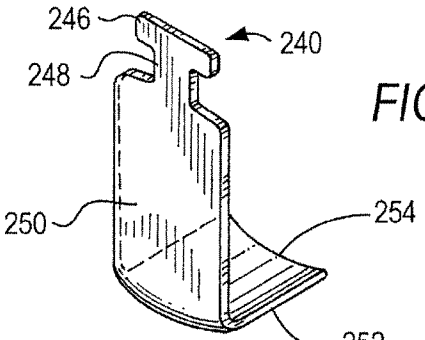
FIG. 7 is an enlarged, perspective view of a detail of the device of FIG. 5.

FIG. 5 depicts another embodiment of a food handling device 220 that is similar to the food handling device 120. The food handling device 220 includes a tubular holder 226 bounding an interior in which the foodstuff 140, as described above, is placed. The holder 226 has a longitudinal channel or slot 228. The holder 226 can have various shapes, for example, a cylindrical shape, or a conical shape suitable for compact storage, transport, and handling. A pulling assembly 230 includes a bracket 234 mounted on the holder 226 for sliding longitudinal movement lengthwise of the slot 228, and a movable member 240 shown individually in FIG. 7. As best seen in FIG. 6, the bracket 234 has an outer flange 236 located outside the holder 226, an inner flange 238 located inside the holder 226, a connecting portion 242 that interconnects the flanges 236, 238 and that is located in the slot 228, and a passage 244 that extends through the flanges 236, 238 and the connecting portion 242. The movable member 240 has a handle portion 246 at one end, a neck portion 248 that extends through the passage 244, an upright arm portion 250, and an elongated body or support portion 252 that preferably terminates in a concave edge 254. The handle portion 246 is positioned perpendicularly to the passage 244. Prior to use of the food handling device 220, the pizza slice 140 and all its toppings are fully contained within the device 220. During eating, only the leading end of the pizza slice 140 is exposed for eating.

Again using the pizza slice 140 as an example of a foodstuff that can advantageously be placed inside the holder 226, the pizza slice 140 is placed on top of the movable member 240 such that its rear crust at its broader end is adjacent the upright arm portion 250. In a variation, the pizza slice 140 need not be placed on top of the movable member 240, but instead, could be positioned axially adjacent the pizza slice 140. In use, the user 118 holds the device 220 with one hand near the user's mouth. Then, the user grips the handle portion 246 or the bracket portion 234 with the user's other hand, and progressively pulls the movable member 240 towards the user with the user's other hand, and incrementally slides the bracket 234 and the movable member 240 lengthwise of the slot 228 and the holder 226, thereby enabling the user to progressively advance the pointed front leading end of the pizza slice 140 in steps out of the holder 226 in order to eat the pizza slice 140 bite-by-bite in a sanitary manner, that is without spilling any toppings, without soiling one's hand, and without requiring the use of any traditional eating utensils. The movable member 240 can either carry the pizza slice, or push the pizza slice 140, during such movement.

Figure 8:
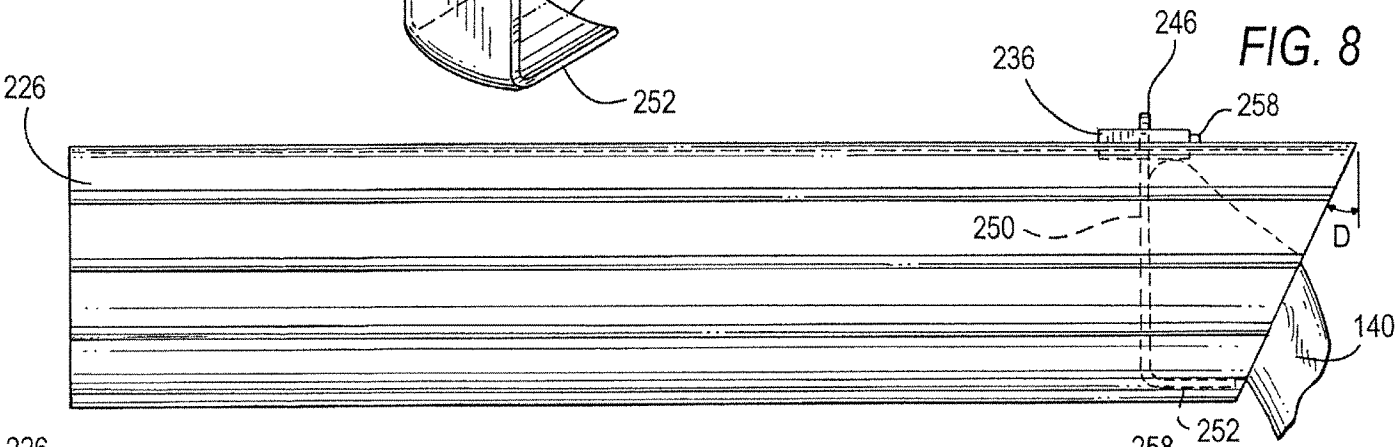
FIG. 8 is an enlarged, side view of the device of FIG. 5.

The concave edge 254 helps to insure that the user will not bite down hard on the movable member 240 during eating. Similarly, as shown in FIG. 8, the outer end of the holder 226, i.e., the end that is closest to the user's mouth during eating, is rearwardly tapered by an angle "D", to again prevent the user from biting down hard on the outer end of the holder 226. The concave edge 254 on the movable member 240 and the outer tapered end of the holder 226 could also be implemented on the movable member 130 and the holder 126 described above. A plurality of food handling devices 220 may be arranged on the platter 114 in analogous manner to that described above for food handling devices 120.

Figure 9:
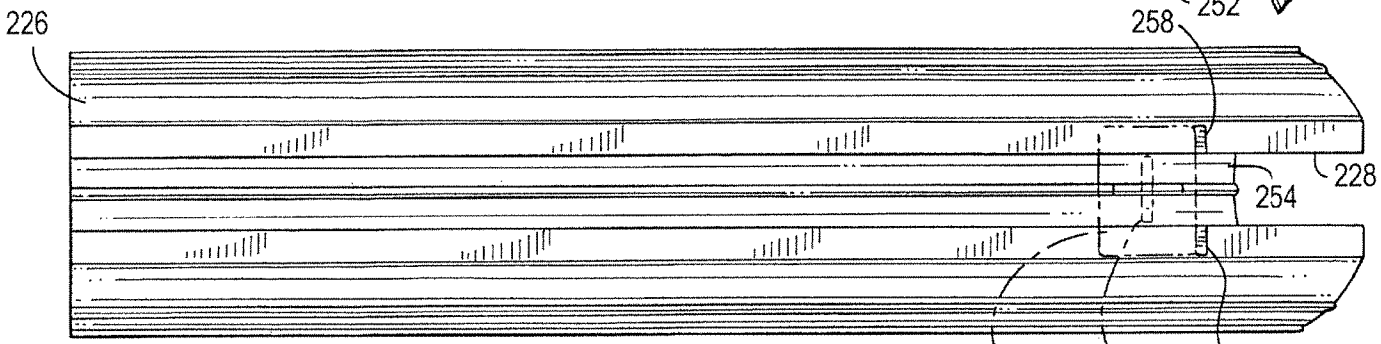
FIG. 9 is an enlarged top plan view of FIG. 8.

FIG. 9 also depicts a pair of stops 258 that abut against the upper flange 236 of the sliding bracket 234 and prevent the sliding bracket 234 from moving past the stops 258. Similar stops could be provided on the holder 126 described above to prevent the movable member 130 from moving off the holder 126. In addition, the holder 226 could be provided with the above-described sensors 146. The holder 226 is advantageously constituted of the same materials described above for holder 126.

Figure 12:
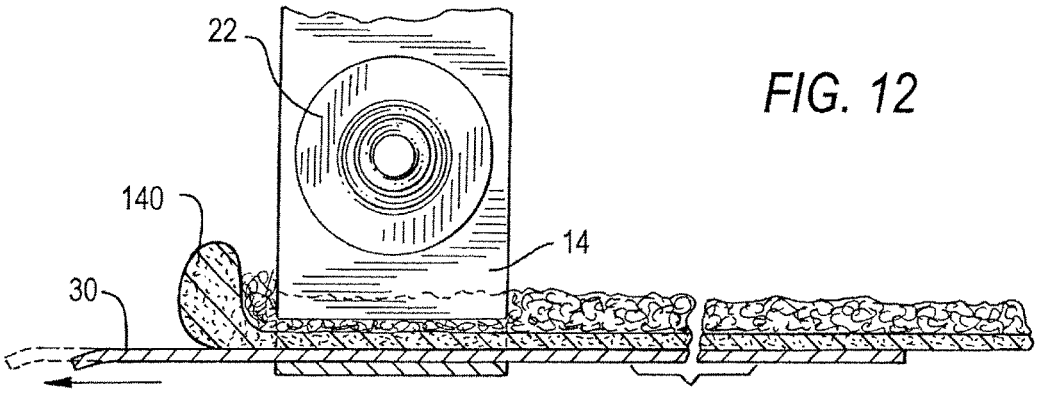
FIG. 12 is a sectional view taken on line 12-12 of FIG. 10.

Turning now to the food handling device 10 of FIGS. 10-12, a portable holder is configured from an elongated, adjustable strip having opposite end regions 12, 14 that are brought together to form an annular body portion 16 bounding an interior. The strip is advantageously made of a resilient material, such as plastic, but could also be made of other materials. A first pair of fasteners 18 are fastened together, and a second pair of fasteners 22 are fastened together, each fastener being preferably of the snap type, with enough excess material from the strip, to form an annular central portion 20. The above-described foodstuff 140 is supported on a movable member 30, and they are jointly mounted within the interior of the annular body portion 16. The opposite end regions 12, 14 extend at least partly diametrically across the annular body portion 16 into engagement with the foodstuff 140 and serve as a resilient holding portion for fixedly holding the foodstuff 140 against movement. A plurality of eating accessories, such as utensils, e.g., a knife, fork, spoon, or pair of chopsticks, as well as napkins or straws, are mounted and held within the annular central portion 20. In addition, one or more such eating accessories could be mounted in a V-shaped recess located at the top of the annular body portion 16.

In use, as shown in FIG. 12, the pizza slice 140 is placed on the movable member 30, advantageously configured as a plate, e.g., a paper plate, and the plate with the pizza slice 140 thereon are bent into a curved shape to conform to the inner circumferential surface of the annular body portion 16 and jointly placed underneath the resilient holding portion 12, 14, which advantageously is first pushed up to make clearance for the curved plate with the pizza slice 140 thereon, and then released to return by spring action from the central portion 20 to the illustrated position. As noted above, the resilient holding portion 12, 14 engages the pizza slice 140 and holds the same stationary. Then, the user 118 holds the device 10 with one hand, and grips a rear portion of the movable member 30 with the other hand, and progressively pulls the movable member 30 along a longitudinal direction relative to the pizza slice 140 away from the user with the other hand, thereby enabling the user to incrementally expose the pointed front end of the pizza slice 140 in order to eat the pizza slice 140 bite-by-bite in a sanitary manner, that is without spilling any toppings, without soiling one's hand, and without requiring the use of any traditional eating utensils. A plurality of food handling devices 10 may be arranged on the platter 114 in analogous manner to that described above for food handling devices 120, 220.

Figure 13:
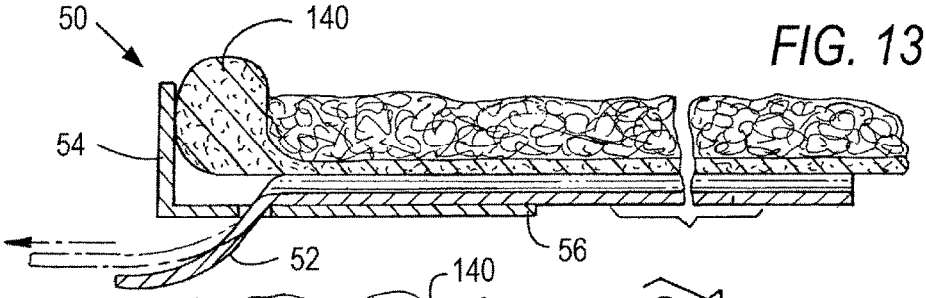
FIG. 13 is a broken-away, side view of another embodiment of a food handling device in accordance with this disclosure.
Figure 14:
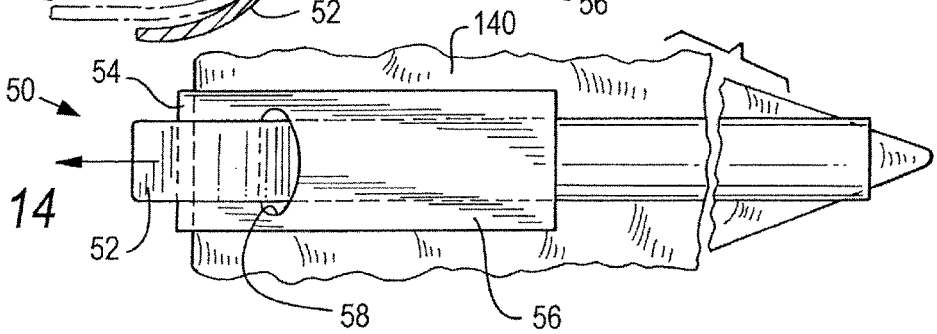
FIG. 14 is a broken-away, bottom plan view of the device of FIG. 13.

Turning now to the food handling device 50 of FIGS. 13-14, a portable holder includes a base portion 56 on which a movable member 52 and the above-described foodstuff 140 are supported, a raised projection 54 for holding the foodstuff 140, and a slot 58 through which the movable member 52 passes. Preferably, the movable member 42 is curved in an arch to add strength to support the pizza slice 140. In use, as shown in FIG. 13, the user 118 holds the holder with one hand, grips a rear portion of the movable member 52 with the other hand, and progressively pulls the movable member 52 through the slot 58 along a longitudinal direction relative to the pizza slice 140 away from the user with the other hand, thereby enabling the user to incrementally expose the pointed front end of the pizza slice 140 in steps in order to eat the pizza slice 140 bite-by-bite in a sanitary manner, that is without spilling any toppings, without soiling one's hand, and without requiring the use of any traditional eating utensils. The raised projection 54 serves as a stop flange against which the rear end of the pizza slice 140 abuts, and holds the pizza slice 140 in a fixed position during movement of the movable member 52. In a variation, the raised projection 54 can be a pointed barb or tooth which pierces the pizza slice 140 to fix the latter in a stationary position. A plurality of food handling devices 50 may be arranged on the platter 114 in analogous manner to that described above for food handling devices 120, 220, 10.

Figure 15:
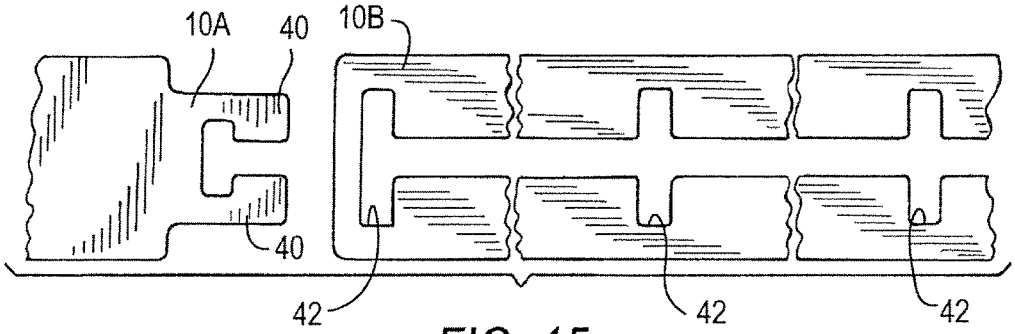
FIG. 15 is a broken-away, side view of a detail of the food handling device of FIG. 10.

FIG. 15 depicts one method of adjusting the perimeter of the annular body portion 16 of the device 10. Thus, one end portion 10A of the strip has a projecting portion with a pair of resilient prongs 40, and the other end portion 10B of the strip has a plurality of recesses 42 arranged successively apart lengthwise of the strip. The resilient prongs 40 engage with a snap type action into any selected one of the recesses 42 to adjust the perimeter of the annular body portion 16 of the strip to accommodate different sizes and shapes of the foodstuff and the movable member placed therein.

Thus, for the food handling devices 10, 50, the pizza slice 140 is held stationary, while each moving member 30, 52 is moved relative to the pizza slice 140 away from the user. By contrast, for the food handling devices 120, 220, the movable members 130, 240 are jointly movable with their respective pizza slices 140 towards the user.

As described so far, the lower end of the support 112 of the food service assembly is adapted to be supported on top of a generally horizontal support surface, such as a table top or countertop, with the aid of the base 116. Other mounting configurations are also contemplated. For example, FIG. 16 depicts a spring-biased clip or clamp 150 having opposing jaws 152 that grip upper and lower surfaces of a generally horizontal support surface 154. The jaws 152 could also be concave to grip opposite sides of a different support surface, such as a round post or pole. The lower end of the support 112 is connected to the clamp 150 via an adapter 156 in which a resilient cushion 158 is received. The cushion 158 compresses under the weight of the food service assembly and self-adjusts as needed in order to compensate for any tilting of the support 112 created by any variation in the size of the support surface 154 and any variation in the opening of the clamp 150. The adapter 156 need not be mechanically fixed to the clamp 150 as shown, but could be magnetically attached thereto, and could also be mounted for turning movement about a vertical axis thereon.

As another example, the lower end of the support 112 can be mounted on a round post or pole staked into the ground or sand as on a beach, or in the snow. FIG. 17 depicts a ski pole 160 on which a food service assembly comprised of the platter 114 and the support 112 are detachably mounted with the aid of a tubular clamp 162.

As another example, as shown in FIG. 18, the lower end of the support 112 can be configured with a first enlarged frustoconically-shaped adapter portion 60 that, in turn, is located above a second enlarged frustoconically-shaped adapter portion 62. The adapter portions 60, 62 need not be frustoconically-shaped, and the support 112 can comprise only one of these adapter portions, or additional adapter portions. Each adapter portion 60, 62 is configured to be received in a correspondingly sized compartment in a cupholder that may be provided in a vehicle, such as a car, boat, or plane, typically in a console or dashboard area adjacent a seat, or in an armchair or seat, such as those located in theaters, arenas, stadiums, outdoor seating areas, etc. Thus, the support 112 of FIG. 18 enables the food service assembly 110 of FIG. 1 to be conveniently supported and stably held anyplace where a cupholder exists. No additional adapter is required, because at least one of the adapter portions 60, 62 will fit into the correspondingly sized compartment of the cupholder. This feature is of especial benefit when the user is being served at a drive-through station of a fast food store.

As also shown in FIG. 18, the support 112 may have an adjustable length. For example, the support 122 may comprise a pair of telescoping sections 112A, 112B whose overall length is adjustable by sliding one of the sections relative to the other of the sections. This adjustability may be used to position a food handling device at about the same elevation as a user's mouth. For example, a patient at a hospital or rehabilitation center, an invalid, or an incapacitated or handicapped person may be unable to use one of his or her hands to hold the food handling device, in which case, the food handling device may conveniently be placed on the platter 114 and remain thereon so that the platter 114 holds the food handling device. Then, the length of the support 112 and, hence, the elevation of the platter 114 relative to a support surface, e.g., the floor, a table, etc., can be varied to position the food handling device at about the same elevation as the user's mouth. The upper end 66 of the upper section 112B may be connected to the platter 114 by various types of connections, both detachable and permanent. For example, the platter 114 may be detachably mounted on the support 112 with a threaded fit, a non-threaded fit, a friction fit, an interference fit, a snap action fit, or a clearance fit.

Figure 19:
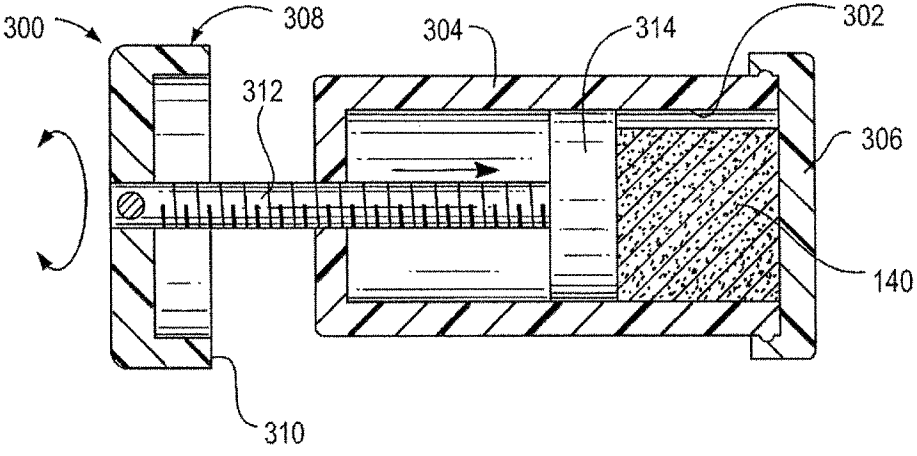
FIG. 19 is a sectional view of still another embodiment of a food handling device in accordance with this disclosure.

FIG. 19 depicts another embodiment of a food handling device 300 in which the solid foodstuff 140 is mounted in a chamber 302 of a tubular holder 304. A detachable end cap 306 is removably mounted at one end of the holder 304. A movable member 308 includes a handle 310 outside the holder 304, and a shaft 312 that threadedly engages an opposite end of the holder 304, and that extends into the chamber 302. A pusher 314 is mounted at the end of the shaft 312. Once the cap 306 is removed, manually turning the handle 310 causes the shaft 312 to turn and the pusher 314 to advance axially, thereby horizontally pushing the foodstuff 140 out of the chamber 302. Advantageously, a user turns the handle 310 in angular increments so that the solid foodstuff 140 can be directly fed to the user's mouth and sanitarily eaten bite-by-bite without the aid of utensils.

Figure 20:
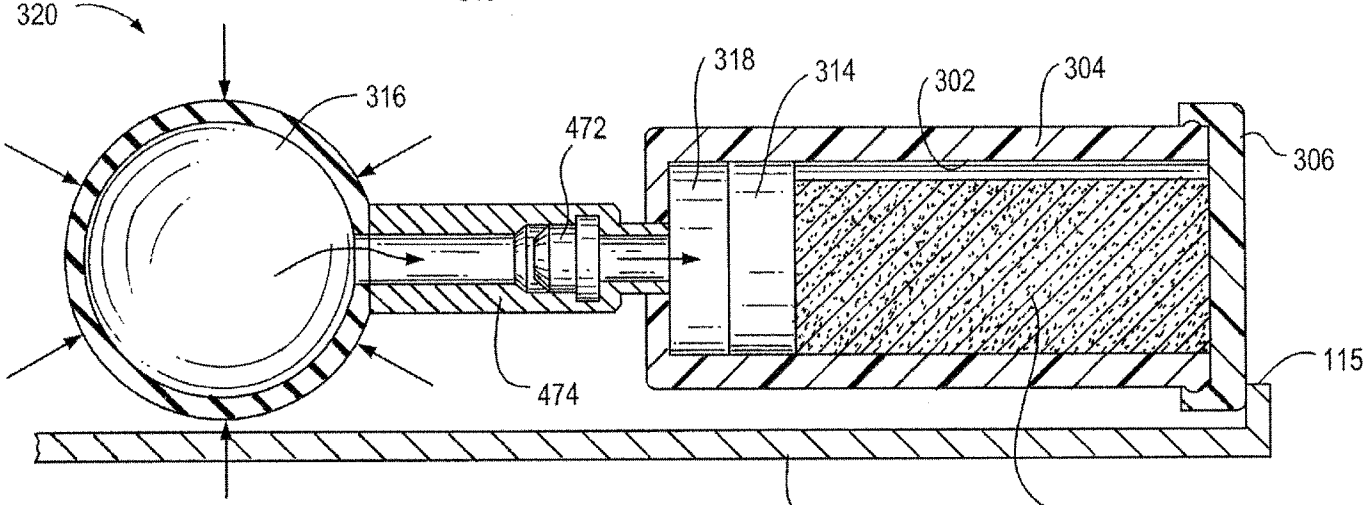
FIG. 20 is a part-sectional view of yet another embodiment of a food handling device in accordance with this disclosure.

FIG. 20 depicts another embodiment of a food handling device 320 that is similar to the food handling device 300, except that the handle 308 and the shaft 312 have been replaced by a squeezable air pump 316 that is in gaseous communication via a check valve 472 in a duct 474 with an internal pressure compartment 318 of the holder 304. Advantageously, once the cap 306 is removed, a user manually squeezes the pump 316 in increments so that pressurized air is admitted into the duct 474 and pushes against and moves the check valve 472 to an open position, thereby opening a flow path to the internal pressure compartment 318. The pressurized air in the internal pressure compartment 318 then urges the pusher 314 axially, and also horizontally and incrementally advances the solid foodstuff 140, thereby again allowing the solid foodstuff 140 to be directly fed to the user's mouth and sanitarily eaten bite-by-bite without the aid of utensils. FIG. 20 also depicts the aforementioned platter 114 on which any of the food handling devices described herein may be supported. Advantageously, the platter 114 has a peripheral, raised flange 115 to prevent any food handling device from accidentally falling off the platter 114 when the platter 114 is tilted and/or when the height of the support 112 is adjusted. The food handling device may be placed against the flange 115 to hold the food handling device in place while a user eats directly from the device while holding the support 112 in one hand.

FIG. 21 depicts another embodiment of a food handling device 330 that may be removably mounted inside an outer housing 332 that has a removable cap 334. Preferably, the housing 332 and the cap 334 are made of a thermally-insulating material to serve as a thermos for a foodstuff in the food handling device 330. The food handling device 330 includes a tubular holder 336 having an internal compartment 338 in which a solid foodstuff is contained during eating. An end closure 340 is threadedly connected at region 342 to the holder 336. A movable member includes a handle 344, an annular corrugated member 346, an annular indexing member 348, and a pusher 350 that is connected to the corrugated member 346, for example, by a pin connector 476. The outer surface of the corrugated member 346 has a series of annular peaks or ridges that alternate with a series of annular valleys or grooves. The indexing member 348 is fixedly held within the end closure 340 and, as shown in FIG. 22, has a series of radially extending, resilient fingers 352 separated by radial slits. Advantageously, once the cap 334 is removed, a user manually pushes the handle 344 and the corrugated member 346 axially until the fingers 352 of the indexing member 348, which initially is seated in one of the valleys, resiliently yield, and allow the indexing member 348 to become seated in another of the valleys of the corrugated member 346. The incremental, stepwise advancement of the corrugated member 346 also horizontally and incrementally advances the pusher 350 and the foodstuff lengthwise along the chamber 338 so that the solid foodstuff can be directly fed to the user's mouth and sanitarily eaten bite-by-bite without the aid of utensils. The user can also grip the handle 344 and manually retract the pusher 350 horizontally in order to reload the food handling device with another foodstuff.

Figure 23:
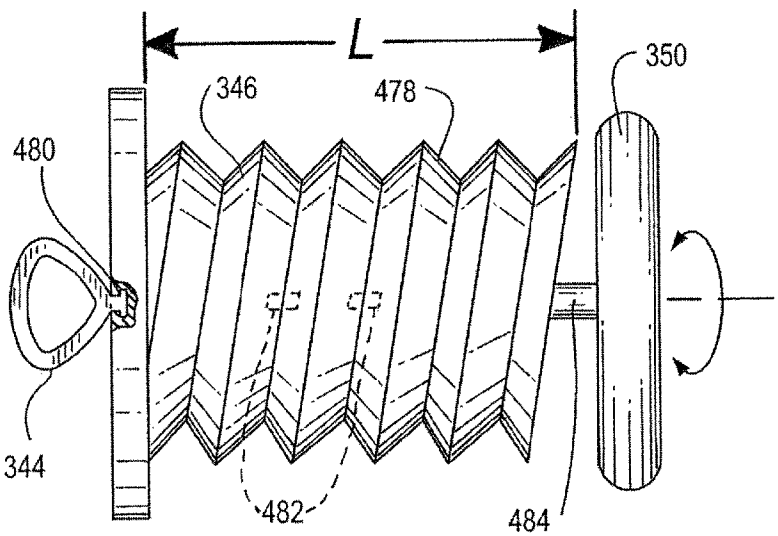
FIG. 23 is a side view of a variant detail of the embodiment of FIG. 21.

Alternatively, as shown in FIG. 23, the member 346 can be provided with an outer spiral thread 478 so that the handle 344 and the member 346 can be manually turned in one circumferential direction in a manner analogous to advancing a screw to advance the member 346 relative to the indexing member 348. Manually turning the handle 344 and the member 346 in an opposite circumferential direction causes the member 346 to retract in order to make room for another foodstuff. As also shown in FIG. 23, the handle 344 may be pivotably connected to the member 346 at pivot 480 to allow the handle to be folded flat when not in use against the member 346. The member 346 can be of one-piece construction, or may comprise a plurality of sections, each attachable by a connector 482 to a shaft 484. The number of such sections is selectable to adjust the length "L" of the member 346. The size and shape of the ridges, grooves, and the spiral is also selectable to adjust the size of each increment by which the foodstuff is advanced. The member 346 is cleanable and re-usable.

Figure 24:
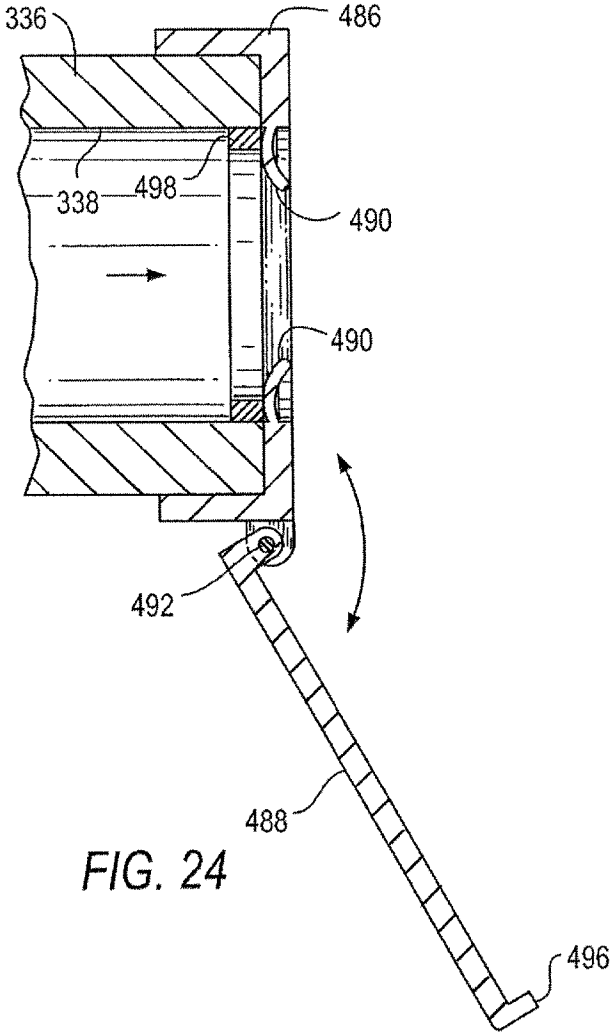
FIG. 24 is a broken-away, side sectional view of another detail of the embodiment of FIG. 21.

FIG. 24 depicts a front end piece 486 that is threadedly mounted at the outer end region of the tubular holder 336. A closure 488 is pivotably mounted on the front end piece 486 at the pivot 492 for movement between an open and a closed position. The closure 488 has a fastener 496 that engages the front end piece 486 in the closed position. As shown in FIG. 25, the front end piece 486 has a plurality of equiangularly arranged, concave, resilient lips 490 constituted of a soft, flexible material. The lips 490 bound a central dispensing opening 494. In the open position, when the user either axially manually pushes the member 346 (FIG. 21) or manually rotates the member 346 (FIG. 23), the foodstuff is pushed out through the opening 494 past the lips 490 directly into the user's mouth so that it can be sanitarily eaten bite-by-bite without the aid of utensils. The lips 490 help prevent accidental spillage of the foodstuff. The soft and concavely curved nature of the lips 490 enables them to be comfortably positioned in contact with the user's lips and mouth. A sensor, e.g., a transducer 498, is threadedly mounted inside the tubular holder 336 adjacent to the front end piece 486. The sensor 498 is an annular disc having a central opening through which the foodstuff is pushed. The sensor 498 includes a strain gauge that can measure the quantity of the foodstuff that has been moved through the front end piece 486 and has been eaten. This information can be stored, together with the caloric value of the particular foodstuff, and can be sent to remote monitoring facilities that calculate the user's daily calorie consumption data, to thereby monitor the health, and assist in controlling the weight of, the user.

Figures 26, 27, 28:
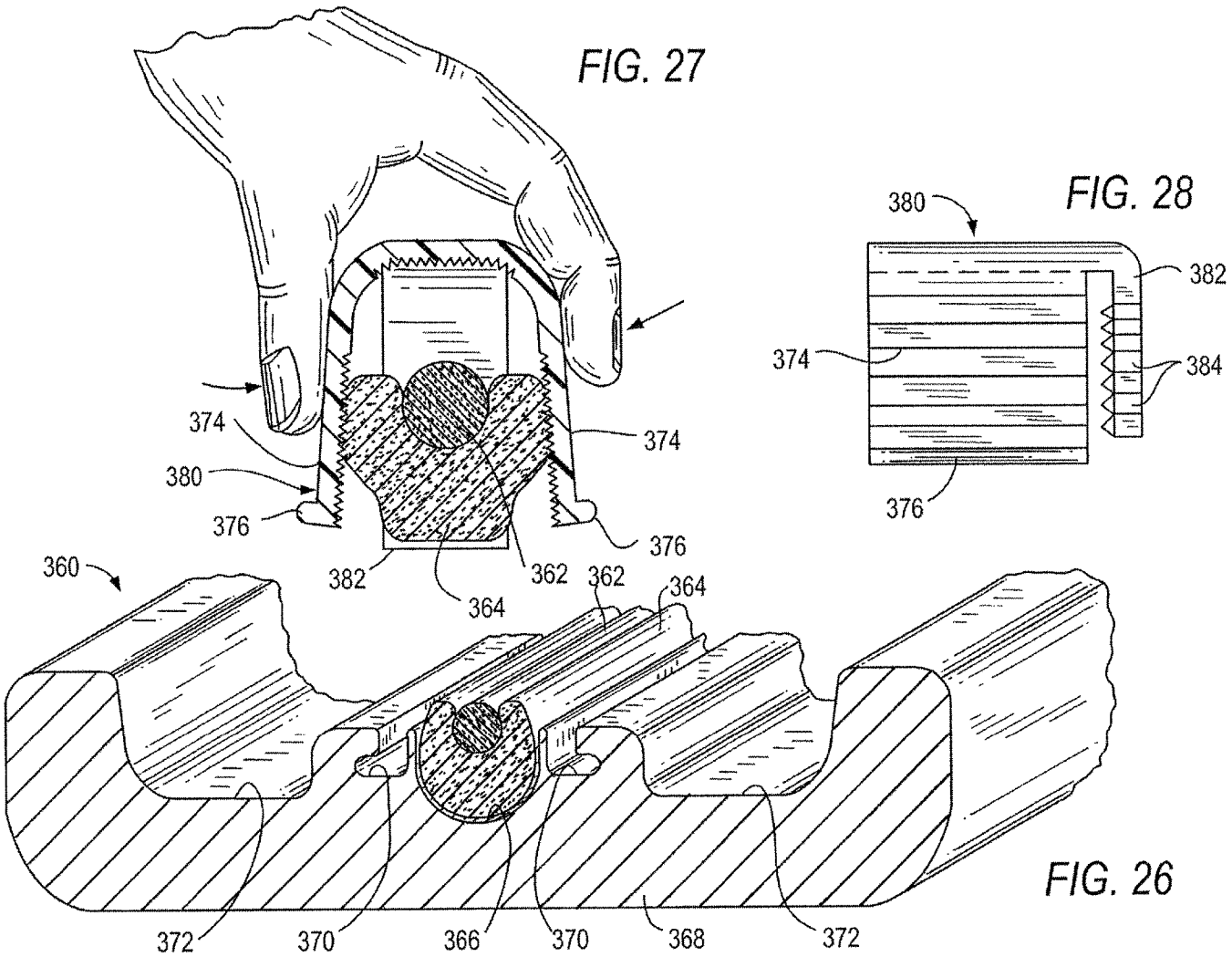
FIG. 26 is a broken-away, par-sectional, perspective view of another embodiment of a food handling device in accordance with this disclosure.
FIG. 27 is a sectional view of a food handling component used with the food handling device of FIG. 26.
FIG. 28 is a side view of the food handling component of FIG. 27.

FIG. 26 depicts another embodiment of a food handling device 360 that is advantageously configured for eating a hot dog, i.e., a cooked sausage 362 served in a sliced bun 364, or a burrito, or like solid foodstuffs. The hot dog is placed in a longitudinal main channel 366 of a holder 368. The holder 368 has a pair of longitudinal guide channels 370 at opposite sides of the main channel 366, and may have another pair of side channels 372 at opposite sides of the guide channels 370. The side channels 372 may advantageously hold condiments, such as mustard, or other foodstuffs, such as relish or sauerkraut. FIGS. 27-28 depict a movable member 380 that is used to manually advance the hot dog being served on the food handling device 360. The movable member 380 has a pair of resilient side walls 374 that may be urged toward each other to capture the hot dog therebetween. The inner surfaces of the side walls 374 may be roughened or serrated to better grip the hot dog. The side walls 374 have lower feet 376 that are slidably mounted in the guide channels 370. Advantageously, a user manually squeezes the side walls 374 together to grip the hot dog, and then incrementally manually advances the hot dog lengthwise of the main channel 366 so that the hot dog can be directly fed into the user's mouth and sanitarily eaten bite-by-bite without the aid of utensils. As shown in FIG. 28, an end wall 382 is provided at the rear of the movable member 380. The hot dog can abut the end wall 382. A series of detachable portions 384 may be provided on the end wall 382. The inner surfaces of the detachable portions 384 may be roughened or serrated to better grip the hot dog. A selected number of the detachable portions 384 may be detached from the end wall 382 to adjust the height of the end wall 382 to better match the height of the hot dog. As shown in FIG. 28, the side walls 374 may also be corrugated and compressible to adjust the height and width of the side walls 374 to better match the height and width of the hot dog. The corrugated side walls 374 provide a better grip on, and also provide better heat isolation from, the hot dog.

Figure 31:
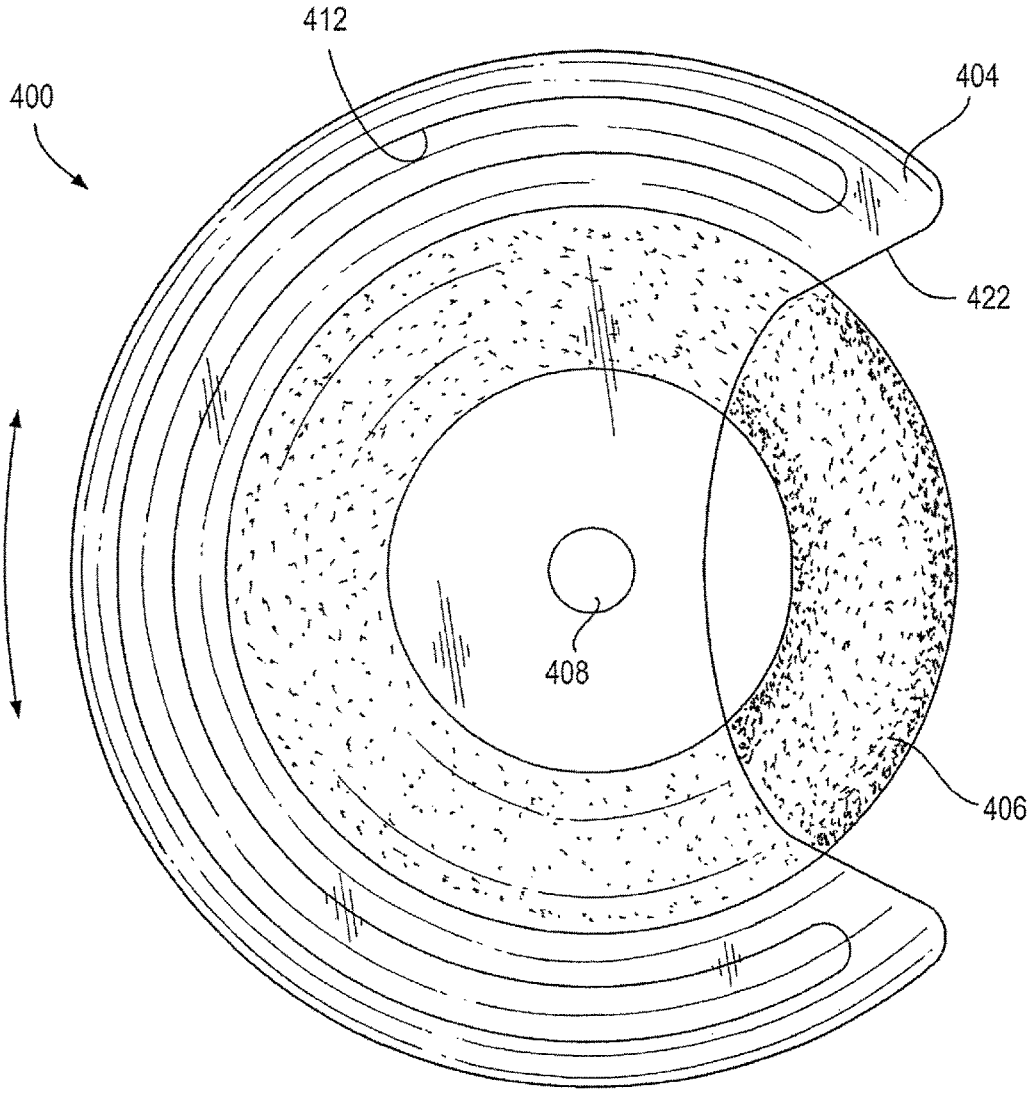
FIG. 31 is an enlarged, top plan view of the food handling device of FIG. 30.

FIGS. 29-31 depict another embodiment of a food handling device 400 that is advantageously configured for eating a doughnut, a bagel, a cake, or an analogous solid foodstuff 406. The food handling device 400 includes a holder 404 that has a central projection 408 that can extend into a central hole in the foodstuff 406, an annular main channel 410 that surrounds the projection 408 and that holds the foodstuff 406, and an annular side channel 410 that surrounds the main channel 410 and that may advantageously hold condiments or the like. A central bore 414 underneath the projection 408 receives a stub 416 of a housing 402 in which the food handling device 400 may be contained. The housing 402 may have snap-type connectors 418 or other connectors to enable the housing 402 to be opened or closed. A movable member 420 rests on top of the foodstuff 406 and is manually turnable in either circumferential direction about a vertical axis. An inner surface of the movable member 420 may be roughened or serrated to better grip the foodstuff 406. As shown in FIG. 31, the movable member 420 has a cutout 422 in which a portion of the foodstuff 406 is exposed. Advantageously, a user manually turns the movable member 420 to a desired angular extent, and can directly eat the portion of the foodstuff exposed in the cutout 422 in a sanitary, bite-by-bite manner without the aid of utensils. The cutout 422 is provided with rounded edges that are not sharp to prevent injury to the user during eating.

FIGS. 32-33 depict still another embodiment of a food handling device 450 in which the foodstuff is mounted in a chamber 452 of a tubular holder 454. The closure 488 and the front end piece of FIG. 24 may be mounted on the outer end of the holder 454. A movable member includes a motor 456 outside the holder 454, and a shaft 458 that threadedly engages the holder 454, and that extends into the chamber 452. A food stop or abutment member 460 is mounted at the end of the shaft 458 to abut against a foodstuff received in the chamber 452. The motor 456 is operative for automatically turning the shaft 458 in either circumferential direction under the control of controllers 462. The motor 456 is mounted on a support 464 and is energized by a battery 461. A sliding piston 466 is mounted for telescoping sliding movement inside a cylinder 468 that is mounted on the support 464. The piston 466 is connected to the holder 454 by a pin 471. A heater 470 may be provided on the holder 454 to warm the foodstuff therein. Advantageously, a user actuates a controller 462 to energize the battery-powered motor 456 and turn the shaft 458 in one circumferential direction, thereby causing relative motion between the stop 460 and the bolder 454. The foodstuff remains stationary, while the holder 454 is moved horizontally and incrementally toward the left in FIG. 32. The foodstuff is thus incrementally exposed so that it can be directly eaten in a sanitary, bite-by-bite manner without using utensils. The user can actuate the other controller 462 to energize the motor 456 and turn the shaft 458 in the opposite circumferential direction, thereby causing the holder 454 to move toward the right in FIG. 32, whereupon the holder 454 may be loaded with another foodstuff. The aforementioned sensor 498 (FIG. 24) can also be supported by the holder 454 at its front end region to measure the quantity that the foodstuff has been moved.

Figure 34:
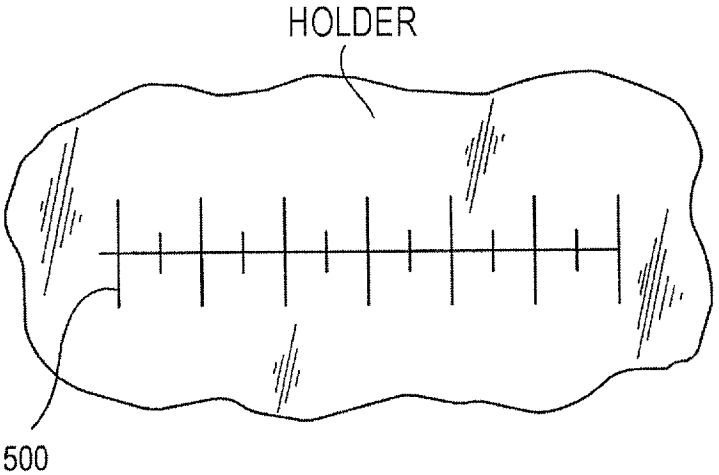
FIG. 34 is a broken-away, top view of a detail of the food handling devices.

The food handling devices disclosed herein can be advantageously used virtually anywhere indoors or outdoors, and even in weightless environments, in many different types of activities. The various holders disclosed herein, e.g., holders 304, 336 and 454, may advantageously be constituted of a light-transmissive material on which a series of markings 500, as shown in FIG. 34, is applied. The markings 500 may be accompanied by alphanumeric indicia and may be formed integrally with the holders, or may be printed or otherwise applied on the holders. The foodstuff is visible through the respective light-transmissive holder, and the markings 500 serve as visual indicators as to the distance through which the foodstuff has been moved or exposed. This distance can be used to determine the caloric value of the particular foodstuff being eaten. The food handling devices disclosed herein can be advantageously made at least in part of disposable and/or biodegradable materials. The food handling devices disclosed herein can be washed in a dishwasher, cooled in a refrigerator, and heated in a microwave oven.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. For example, the food service assemblies and food handling devices described herein can also be used by campers, or military personnel, or participants in any outdoor or indoor activities, such as picnics, block parties, beach activities, hiking, or sports activities, especially those where it is difficult to keep one's hands clean.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to, as understood by one of ordinary skill in the art. The term "coupled" is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. A food handling device for use in eating a foodstuff, comprising:

a holder having an interior chamber for receiving and for holding the foodstuff, the interior chamber extending along a longitudinal axis to an opening;

a pusher mounted in the chamber and abuttingly engaging the foodstuff in non-pressured, relaxed, static contact with the foodstuff; and an actuator for moving the pusher and for incrementally feeding a continuously variable quantity of the foodstuff along the longitudinal axis through the opening directly into a user's mouth to enable the foodstuff to be eaten bite-by-bite in a sanitary manner without using utensils.

2. The device of claim 1, wherein the actuator includes a handle connected to a shaft that threadedly engages the holder, and a wherein the pusher is connected to the shaft inside the chamber.

3. The device of claim 1, wherein the pusher bounds an internal pressure compartment, and a squeezable air pump in gaseous communication with the pressure compartment for manually pumping pressurized air along a flow path into the pressure compartment and against the pusher for pushing the foodstuff out of the chamber.

4. The device of claim 3, and further comprising a valve in the flow path, and wherein the valve has an open position when the pressurized air is pumped therethrough.

5. The device of claim 1, wherein the actuator includes a motor operatively connected to the holder for automatically moving the pusher.

6. The device of claim 1, and a heater for warming the foodstuff within the holder.

7. The device of claim 1, and a sensor for measuring a quantity of the foodstuff fed to the user's mouth.

8. The device of claim 1, and a series of markings on the holder for indicating a distance over which the foodstuff is fed to the user's mouth.

9. The device of claim 1, and a platter for supporting the food handling device, and wherein the platter has a raised flange to prevent the food handling device from accidentally falling off the platter.

10. The device of claim 1, wherein the device is constituted at least in part of disposable and biodegradable materials.

11. A food handling device for use in eating a foodstuff, comprising:

a hollow, tubular holder extending along a longitudinal axis to an end region, the holder having a side wall that entirely surrounds the longitudinal axis and that bounds an interior chamber for receiving the foodstuff;

a closure mounted on the end region of the holder for movement between an open and a closed position; and a movable member including a pusher mounted in the chamber for abuttingly engaging the foodstuff non-pressured, relaxed, static contact therewith, and for incrementally feeding a continuously variable quantity of the foodstuff along the longitudinal axis directly into a user's mouth in the open position of the closure to enable the foodstuff to be eaten bite-by-bite in a sanitary manner without using utensils.

12. A food handling device for use in eating a foodstuff, comprising:

a holder having an interior chamber for receiving the foodstuff, the interior chamber extending along a longitudinal axis;

an indexing member fixedly held in the holder and having resilient fingers extending radially of the longitudinal axis;

a corrugated member manually movable relative to the indexing member along the longitudinal axis; and a pusher operatively connected to the corrugated member for joint movement therewith, the pusher being operative for engaging and incrementally feeding the foodstuff directly into a user's mouth to enable the foodstuff to be eaten bite-by-bite in a sanitary manner without using utensils, the corrugated member having a series of annular ridges alternating with a series of annular grooves, each ridge and each groove extending circumferentially around the longitudinal axis, the resilient fingers being initially seated in one of the grooves and being moved to, and seated in, another of the grooves during axial movement of the corrugated member.

13. A food handling device for use in eating a foodstuff, comprising:

a holder having an interior chamber for receiving the foodstuff, the interior chamber extending along a longitudinal axis;

an indexing member fixedly held in the holder and having resilient fingers extending radially of the longitudinal axis;

a manually turnable member turnable around the longitudinal axis and movable along the longitudinal axis relative to the holder; and a pusher operatively connected to the turnable member for joint movement therewith, the pusher being operative for operatively engaging and incrementally feeding the foodstuff directly into a user's mouth to enable the foodstuff to be eaten bite-by-bite in a sanitary manner without using utensils, the turnable member having a spiral thread extending in a spiral around the longitudinal axis, the resilient fingers threadedly engaging the spiral thread during movement of the turnable member.

14. The device of claim 13, wherein the turnable member is comprised of a number of interconnected sections, each having a size and a shape, to adjust a quantity of the foodstuff being fed.

15. A food handling device for use in eating a foodstuff, comprising:

a hollow, tubular holder extending along a longitudinal axis to a front end region, the holder having a side wall that entirely surrounds the longitudinal axis and that bounds an interior chamber for receiving the foodstuff;

a front end piece mounted on the front end region of the holder, the front end piece having resilient flexible lips bounding an opening;

a closure mounted on the front end piece for movement between an open and a closed position; and a movable member including a pusher mounted in the chamber for engaging the foodstuff, and for incrementally feeding the foodstuff through the opening and past the resilient flexible lips directly into a user's mouth in the open position of the closure to enable the foodstuff to be eaten bite-by-bite in a sanitary manner without using utensils.

* * * * *